United States Patent [19]

Ser et al.

[11] Patent Number: 4,750,502

[45] Date of Patent: Jun. 14, 1988

[54] LIQUID PRODUCT DISPENSER, IN PARTICULAR FOR A COSMETIC PRODUCT SUCH AS NAIL VARNISH

[75] Inventors: Jean-Claude H. Ser, Beynes; Louis L. Marcotte, Chevilly la Rue, both of France

[73] Assignee: L'Oreal, Paris, France

[21] Appl. No.: 893,923

[22] Filed: Aug. 6, 1986

[30] Foreign Application Priority Data

Aug. 9, 1985 [FR] France ..... 85 12207

[51] Int. Cl.[4] ..... A45D 29/18

[52] U.S. Cl. ..... 132/74.5; 132/DIG. 3; 132/79 B; 222/160; 401/279

[58] Field of Search ..... 132/74.5, 79 A, 79 B, 132/DIG. 3; 401/278, 279, 276, 135, 265–268, 280; 222/160

[56] References Cited

U.S. PATENT DOCUMENTS

| | | | |
|---|---|---|---|
| 371,899 | 10/1887 | Osborne | 401/276 |
| 487,732 | 12/1892 | Green | 222/160 |
| 1,096,603 | 5/1914 | Cooper | 401/276 |
| 1,935,000 | 11/1933 | Vessey | 401/135 |
| 2,305,158 | 12/1942 | Hanses | 401/276 |
| 2,726,638 | 12/1955 | Hackmyer | 401/135 |
| 3,021,850 | 2/1962 | Smith et al. | 401/279 |
| 3,589,824 | 6/1971 | Andrews et al. | 401/206 |

FOREIGN PATENT DOCUMENTS

| | | | |
|---|---|---|---|
| 13911 | 4/1934 | Australia | 132/74.5 |
| 55055 | 6/1951 | France . | |
| 422157 | 8/1947 | Italy | 401/135 |
| 24019 | of 1911 | United Kingdom | 401/278 |
| 2146588 | 4/1985 | United Kingdom | 401/135 |

*Primary Examiner*—Robert Peshock
*Assistant Examiner*—J. Hakomaki
*Attorney, Agent, or Firm*—Cushman, Darby & Cushman

[57] ABSTRACT

The dispenser comprises a shell enclosing a movable reservoir for the product. A dispensing valve is formed in a zone between the shell and the reservoir. Control member allow a relative displacement to be effected between the shell and the reservoir to open the dispensing valve and to allow the product to flow out. Openable passage are capable of connecting the inside of the reservoir to the atmosphere when the control member are actuated to open the dispensing valve.

8 Claims, 1 Drawing Sheet

LIQUID PRODUCT DISPENSER, IN PARTICULAR FOR A COSMETIC PRODUCT SUCH AS NAIL VARNISH

FIELD OF THE INVENTION

The invention relates to a dispenser for a slightly thixotropic liquid product of the kind comprising a shell wherein a reservoir for the product is movably mounted, a dispensing valve being formed in a zone between the shell and the said reservoir, control means being provided in another zone to allow a relative displacement to be effected between the shell and the reservoir causing the opening of the above mentioned valve and allowing the product to flow outwardly during said displacement, there being re-straining means to ensure the reversal of the displacement and closure of the valve.

The invention concerns more particularly, although not exclusively, a dispenser for a cosmetic product such as nail varnish, or other liquid products such as paint and other liquid varnishes, since it is in this case that its application seems to have the greatest advantage.

PRIOR ART

Known dispensers of this type allow the product to be applied with relative ease, in better safety conditions than those corresponding to the use of a rigid bottle of the product into which a brush is dipped after the bottle has been opened. In fact, with a dispenser of the present invention there is no risk of up-ending the open bottle and the product.

OBJECT OF THE INVENTION

The flow of the product obtained with a dispenser of this kind is not always satisfactory, in particular as regards the regularity of the discharge which depends on the extent to which the reservoir is filled.

The object of the invention is above all to provide a liquid product dispenser of the kind defined above which should meet the various practical requirements better than hitherto and which, in particular, ensures good regularity of flow of the product irrespective of the extent to which the reservoir is filled.

SUMMARY OF THE INVENTION

The present invention provides a dispenser for a slightly thixotropic liquid product, in particular for cosmetic products such as nail varnish or other liquid products such as paint or other varnishes of the type defined above, the dispenser comprising openable means capable of connecting the interior of the reservoir to the atmosphere when the control means have been actuated to open the valve and allow the product to flow, these openable means being adapted to be closed so as to isolate the reservoir from the atmosphere when the said control means have been brought back to their inoperative condition.

Advantageously, the openable means are constituted by a further valve adjacent the control means, said further valve being capable of communicating the interior of the reservoir with the atmosphere during relative displacement of the reservoir and the shell, whereas said communication is interrupted when the control means return to the inoperative condition.

Preferably the shell has an elongate cylindrical shape and the reservoir has a corresponding coaxial shape and is movably mounted for translation along the longitudinal axis of the shell.

The first dispensing valve may comprise a spigot axially traversing the bottom of the shell, said spigot comprising a longitudinal duct which opens laterally inside a cylindrical collar integral with the reservoir, said collar being capable of sliding on the spigot and of closing the lateral opening of the channel in the inoperative condition of the control means, said lateral opening being further capable of communicating with the interior of the reservoir when the reservoir is displaced by operation of the control means.

The further valve is advantageously provided at the opposite end of the reservoir from that fitted with the dispensing valve, said further valve also comprising a spigot which is integral with the bottom of the reservoir and has a duct opening out into the reservoir and opening laterally on the spigot outside the reservoir, said spigot being capable of displacement in a bore connected to the shell, the unit being such that the transverse duct is closed by the wall of the said bore when the control means are in the inoperative condition, whereas this transverse duct communicates with the atmosphere when the control means are actuated for displacing the reservoir and for opening the dispensing valve.

The above mentioned bore may advantageously be formed in a sleeve in the central zone of a stopper mounted at the end of the shell; there may be at least one vent hole in the stopper to communicate the atmosphere with the internal space of the shell into which the transverse duct opens when the control means are actuated.

The control means may comprise a push buttom biased into its inoperative condition by elastic means.

The push button is fixed, in particular by screwing, on to the spigot of the second valve whilst the elastic biasing means are provided between the push button and the stopper.

Catch engagement may hold the dispenser in this operating condition.

Applicator means, such as a brush or a pad, may advantageously be mounted at the end of the shell fitted with the dispensing valve. When this valve comprises a spigot passing through the bottom of the shell and projecting towards the outside, the applicator means is mounted on this projecting portion of the spigot so as to be supplied with product by way of the duct passing through the spigot.

BRIEF DESCRIPTION OF THE DRAWINGS

Apart from the arrangements set out above, the invention consists of a certain number of other arrangements which will be discussed in greater detail below in connection with a particular embodiment described with reference to the attached drawing, but which is in no way restrictive. In the drawing.

DESCRIPTION OF THE PREFERRED EMBODIMENT

Figure 1:
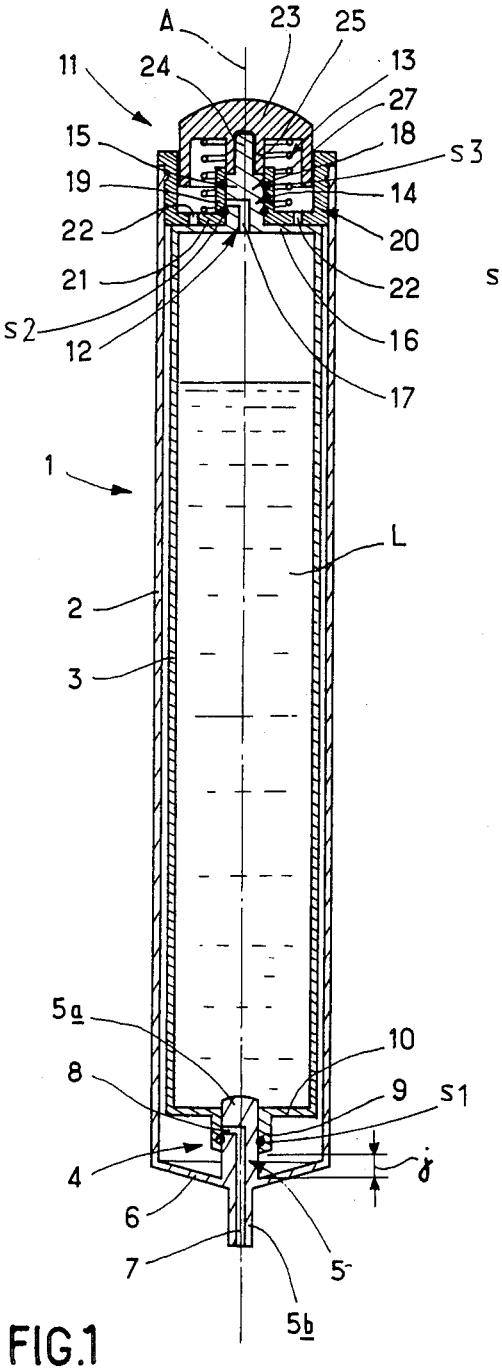
FIG. 1 is a longitudinal cross-section of a dispenser in accordance with the invention in its inoperative condition.

Referring to the drawings, in particular to FIG. 1, a dispenser 1 may be seen for the liquid product L. More precisely, this liquid product L is slightly thixotropic and is constituted in particular by a cosmetic product such as nail varnish.

The dispenser comprises a shell 2, of an elongate cylindrical shape in the embodiment shown. A reservoir 3 for the product, also of a cylindrical elongate shape, and coaxial with shell 2, is movably mounted in this shell 2 for sliding along the direction of axis A.

A dispensing valve 4 is formed in a zone situated at one end of the shell 2 between this latter and the reservoir 3. This valve 4 comprises a spigot 5 passing axially through the bottom 6 of the shell. This bottom has a frustoconical shape convex towards the outside. The spigot 5 comprises a portion 5*a* with a larger diameter situated inside the shell 2, and a portion 5*b* with a slightly smaller diameter projecting outside the shell. The spigot 5 comprises a longitudinal axial duct 7 opening towards the outside and opening laterally inside, via a radially directed perpendicular duct extension 8.

When the end of this extension 8, situated on the external surface of the portion 5*a*, is uncovered the duct 7 communicates via this lateral extension 8 with the interior of the reservoir 3.

The reservoir 3 comprises a cylindrical collar 9 capable of sliding on the portion 5*a* of the spigot 5 situated inside the shell 2. The collar 9 projects longitudinally outwardly relative to the transverse bottom 10 of the reservoir 3.

Towards its end remote from the bottom 10, the internal cylindrical wall of the collar 9 comprises a groove to receive a ring-shaped seal s1 surrounding the spigot 5 below the lateral duct extension 8, that is to say, between this lateral duct extension 8 and the bottom 6 of the shell.

Figure 2:
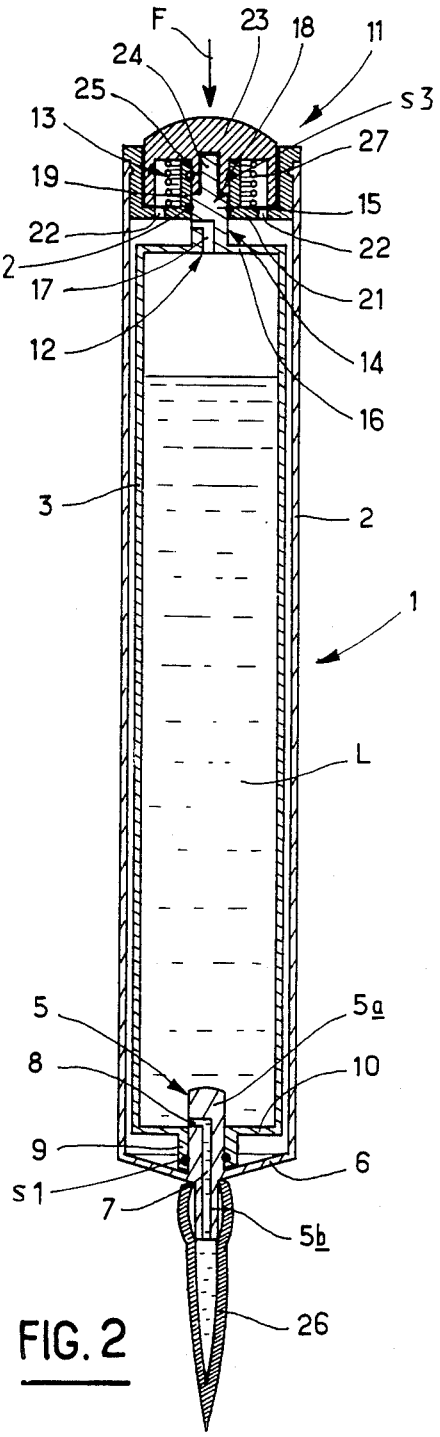
FIG. 2 shows the dispenser of FIG. 1 fitted with an applicator means, in a condition when the control means are actuated.

When the reservoir 3 is in its inoperative condition shown in FIG. 1, the lateral duct extension 8 is closed by the collar 9. The distance i between the end of the collar 9 and the bottom 6 of the shell is sufficient that when the reservoir 3 is displaced in relation to the shell, the lateral duct extension 8 opens into the reservoir 3 while the collar 9 comes to bear against the shell bottom 6 (FIG. 2).

In another zone of the shell 2, situated at its opposite end, control means 11 allow a relative displacement to be effected between the shell 2 and the reservoir 3, achieving opening of the above-mentioned valve 4 and allowing the product L to flow outwardly through the duct 7.

In accordance with the invention, openable means 12 connect the interior of the reservoir 3 to the atmosphere when the control means 11 are actuated to open the valve 4. These openable means 12 are closed so as to isolate the reservoir 3 from the atmosphere when the said control means 11 are brought back to their inoperative condition by biasing means 13.

The openable means 12 are advantageously constituted by a further valve 14 provided adjacent the control means 11, at the opposite end of the shell 2 to that fitted with the valve 4.

This second valve 14 also comprises a spigot 15 projecting axially outwardly in relation to the transverse top panel 16 of the reservoir 3. This spigot 15, which is integral with the central portion of this panel 16 comprises a duct 17, in particular an elbow bent as shown in the drawing, opening axially inside the reservoir 3 and opening laterally on the cylindrical surface of the spigot 15 outside the reservoir 3. This spigot 15 is capable of sliding in the bore 18 of a sleeve 19 connected to the shell 1. More precisely, this sleeve 19 is provided in the central portion of a stopper 20 fixed at the end of the shell 2 and closing this end. The stopper 20 has the shape of an outwardly concave cup and is engaged in the shell 2. The stopper 20 may be held by a tight fit or by catch engagement or by any other means of fixing in the shell.

Two ring-shaped seals s2, s3, are advantageously mounted in annular grooves of the bore 18 and bear against the external cylindrical surface of the spigot 15 or an extension thereof. When the dispenser is closed (FIG. 1), the seals s2, s3 are situated on either side of the lateral opening of the duct 17. In the open position of the dispenser 1 (FIG. 2), the seals s2, s3 are situated on the side of the said lateral opening of the duct 17 which is on the opposite side to that of the reservoir 3.

The transverse bottom panel 21 of the stopper 20 connecting the external cylindrical wall with the sleeve 19 comprises at least one, and preferably several, vent holes 22 communicating the internal space of the shell 2 with the atmosphere.

The control means 11 comprise a push button 23 fixed, in this case by screwing, on a threaded extension 24 having a diameter smaller than that of the spigot 15. The push button 23, which has a convex surface in the form of a spherical cap, is slidably guided by the internal cylindrical surface of the stopper 20. Sufficient clearance exists between the external cylindrical surface of the push button 23 and the internal cylindrical surface of the stopper 20 for the communication between the atmosphere and the vent holes 22 to be maintained.

Catch engagement means (not shown in the drawing) may hold the dispenser in its operating or open position (the FIG. 2 position. This catch engagement may be between the external cylindrical surface of the push button 23 and the internal surface of the side wall of the stopper 20.

The extension 24 of the spigot 15 is accommodated in a recess in a stud 25 situated centrally of the portion of button 23 facing towards the reservoir 3. The external diameter of the stud 25 is equal to or smaller than that of the spigot 15 so that this stud can engage in the bore 18 when the button 23 is pressed, as shown in FIG. 2.

The unit is arranged in such a way that the relative displacement allowed between the shell 2 and the reservoir 3 suffices for the duct 17 to open into the internal space of the shell 2 when the button 23 is pressed (FIG. 2).

Advantageously, the projecting portion 5*b* of the spigot 5 situated at the opposite end to button 23 may be provided with applicator means for dispensing the product, this means being constituted by a brush 26 in the embodiment represented in FIG. 2.

The biasing means 13 are advantageously formed by a helical compression spring 27 disposed between the button 23 and the bottom 21.

This being the case, the operation of the dispenser in accordance with the invention is as follows.

When the push button 23 constituting the control means 11 is in its inoperative position, as shown in FIG. 1, the two valves 4 and 14 are closed so that the reservoir 3 is completely isolated from the outside. The product L cannot flow outwardly and is protected from the atmosphere.

When a flow of the product through the duct 7, is desired, the dispenser 1 is held substantially vertically, with the spigot 5 at the bottom as shown in FIGS. 1 and 2.

The button 23 is pressed downwardly (i.e. in the direction of the arrow F in FIG. 2) so as to compress the spring 27. The button 23 is depressed into the stopper 20 and the reservoir 3 is displaced downwardly in relation to the shell 2.

Following this relative displacement, the lateral extension 8 of the duct 7 opens into the internal space of the reservoir 3, while the duct 17 opens into the internal space of the shell 2 as shown in FIG. 2.

The product L will flow out by gravity through the duct 7, in particular to feed the brush 26.

The flow of the product L is rendered uniform, irrespective of the level of product L in the reservoir 3, thanks to the entry of air ensured by the vent holes 22 and the duct 17 during the outflow of product.

When the pressure on the button 23 is released, the button is biased into its rest position by the spring 27. The reservoir 3 is carried along by the button 23 and is also displaced to reassume its rest position (FIG. 1) in relation to the shell 2. In this position, the product L is again isolated from the outside and is preserved in good condition.

The dispenser of the invention is of a straightforward design whilst ensuring a regular flow of the product.

It is clear that the relative displacement between the shell 2 and the reservoir 3 allowing the flow of the product to be controlled, could be a rotational motion or a combined motion of rotation and of translation, instead of the solely translational motion of the example described.

The dispenser may be used for liquid products other than nail varnish, in particular for paint or other varnishes.

We claim:

1. In a dispenser for a slightly thixotropic product, comprising:

(a) shell means;

(b) reservoir means for the product;

(c) means movably mounting said reservoir means within the shell means;

(d) dispensing valve means formed in a first zone between the shell means and the reservoir means;

(e) control means in a second zone disposed relative to said shell means and the reservoir means to effect relative displacement between the shell means and the reservoir means to open said dispensing valve means and having an operative condition in which flow is permitted of the product outwardly towards the exterior during said displacement and also having an inoperative condition; and (f) biasing means to return the reservoir means to its inoperative position and to close said dispensing valve means;

the improvement wherein the dispenser includes:

(g) openable means capable of connecting the interior of the reservoir means to the atmosphere when the control means are actuated to open the dispensing valve means and of permitting outflow of said product from the reservoir, said openable means being capable of closing so as to isolate the reservoir means from the atmosphere when the said control means return to their inoperative condition;

said shell means having a bottom wall and said reservoir having an integral cylindrical collar adjacent said bottom wall, said dispensing valve means comprising a spigot axially traversing said bottom wall of the shell means, said spigot comprising a longitudinal duct having at one end a lateral opening inside said integral cylindrical collar of said reservoir, said integral cylindrical collar being adapted to slide axially on the spigot and to close said lateral opening of said duct in the operative condition of the control means and of the reservoir means and, said lateral opening being capable of communicating with the inside of said reservoir means when the reservoir means are displaced by said control means;

said openable means comprising further valve means adjacent said control means, said reservoir means including a top wall and said further valve means being located at the opposite end of the reservoir means from the dispensing valve means, said further valve means comprising a spigot which is integral with the top wall of the reservoir means and which includes a duct opening into said reservoir means, said shell means including means defining a bore connected thereto, and said spigot being capable of a displacement in said bore connected to said shell means, the arrangement being such that said duct is closed when the control means are in the inoperative condition whereas said duct is in communication with the atmosphere when said control means are actuated for displacing the reservoir means and for opening the dispensing valve means.

2. A dispenser according to claim 1, wherein the shell means has an elongate cylindrical shape, the reservoir means have a corresponding coaxial shape, and the reservoir means are movably mounted for translation along the longitudinal axis of the shell means.

3. A device according to claim 1, wherein said shell means has one end closed by a separately formed stopper, said bore is provided in a sleeve situated in the central zone said stopper, and at least one vent hole is provided in said stopper to establish communication between the atmosphere and the interior of said shell means.

4. A device according to claim 1, wherein the control means comprise a push button and a compression spring biasing said push button into its inoperative condition.

5. A dispenser according to claim 3, wherein the control means comprise a push button and a compression spring biasing said push button into its inoperative condition, wherein the push button is fixed on the spigot of said further valve means, and wherein the biasing spring is provided between the push button and the stopper.

6. A dispenser according to claim 5, wherein the push button is screwed to the spigot.

7. A dispenser according to claim 1, including applicator means at that end of the shell means at which said the dispensing valve means are located, for dispensing the product.

8. A dispenser according to claim 7, wherein the applicator means is one of a brush and a pad.

* * * * *